US005904636A

United States Patent [19]

Chen

[11] Patent Number: 5,904,636

[45] Date of Patent: May 18, 1999

[54] EXERCISER FOR SURFING

[76] Inventor: Paul Chen, 7771 Goldstream Dr., Richmond, Vancouver, BC, Canada, V7A 1S5

[21] Appl. No.: 09/024,783

[22] Filed: Feb. 17, 1998

[51] Int. Cl.[6] ..... A63B 69/18

[52] U.S. Cl. ..... 482/51; 482/57; 434/60

[58] Field of Search ..... 482/51, 52, 53, 482/57, 70, 148, 34; 434/60, 61, 247, 250, 253

[56] References Cited

U.S. PATENT DOCUMENTS

| | | | |
|---|---|---|---|
| D. 330,236 | 10/1992 | Jarriel et al. | D21/194 |
| 2,964,315 | 12/1960 | Dinning | 434/60 |
| 4,749,180 | 6/1988 | Boomer | 482/51 |
| 4,779,863 | 10/1988 | Yang | 482/57 |
| 4,786,050 | 11/1988 | Geschwender | 482/57 |
| 5,387,167 | 2/1995 | Johnston | 482/57 |
| 5,509,871 | 4/1996 | Giovanni | 482/51 |
| 5,562,574 | 10/1996 | Miller | 482/57 |
| 5,755,643 | 5/1998 | Sands et al. | 482/51 |

*Primary Examiner*—Stephen R. Crow

[57] ABSTRACT

An exerciser a board disposed on a base. The board includes a front end and a rear end each being moved in a circular and reciprocating action and moved in an anti-symmetric way for allowing the board to move along a lateral 8-shaped moving path and for allowing the user to conduct surfing exercise at home. The board includes a front end pivotally coupled to a front shaft and includes a rear end pivotally coupled to a rear axle for allowing the front end and the rear end of the board each to move in the circular and reciprocating action.

4 Claims, 3 Drawing Sheets

EXERCISER FOR SURFING

BACKGROUND OF THE INVENTION

1. Field of the Invention

The present invention relates to an exerciser, and more particularly to an exerciser for surfing exercise.

2. Description of the Prior Art

Surfing exercisers have become more and more popular. However, people may not conduct surfing exercises at home.

The present invention has arisen to mitigate and/or obviate the afore-described disadvantages of the conventional exercisers.

SUMMARY OF THE INVENTION

The primary objective of the present invention is to provide an exerciser for allowing people to conduct surfing exercises at home.

In accordance with one aspect of the invention, there is provided an exerciser comprising a base, a board disposed on the base for supporting a user, the board including a front end and a rear end, means for moving the front end of the board in a circular and reciprocating action, and means for moving the rear end of the board in a circular and reciprocating action, the circular and reciprocating action of the rear end of the board being arranged anti-symmetric relative to the circular and reciprocating action of the front end of the board for allowing the board to move along a lateral 8-shaped moving path. The board is provided for allowing the user to conduct surfing exercise when the board is moved along the lateral 8-shaped moving path.

The base includes a front portion having a shaft and includes a rear portion having an axle, the front end of the board is pivotally coupled to the shaft for allowing the front end of the board to move in the circular and reciprocating action relative to the shaft, and the rear end of the board is pivotally coupled to the axle for allowing the rear end of the board to move in the circular and reciprocating action relative to the axle.

A resistive means is further provided for applying a resistive force against the circular and reciprocating actions of the front end and the rear end of the board. The resistive force applying means includes a first wheel secured on the shaft and rotated in concert with the shaft, a second wheel rotatably supported on the base, and means for coupling the second wheel to the first wheel and for allowing the second wheel and the first wheel to apply the resistive force against the circular and reciprocating actions of the front end and the rear end of the board.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
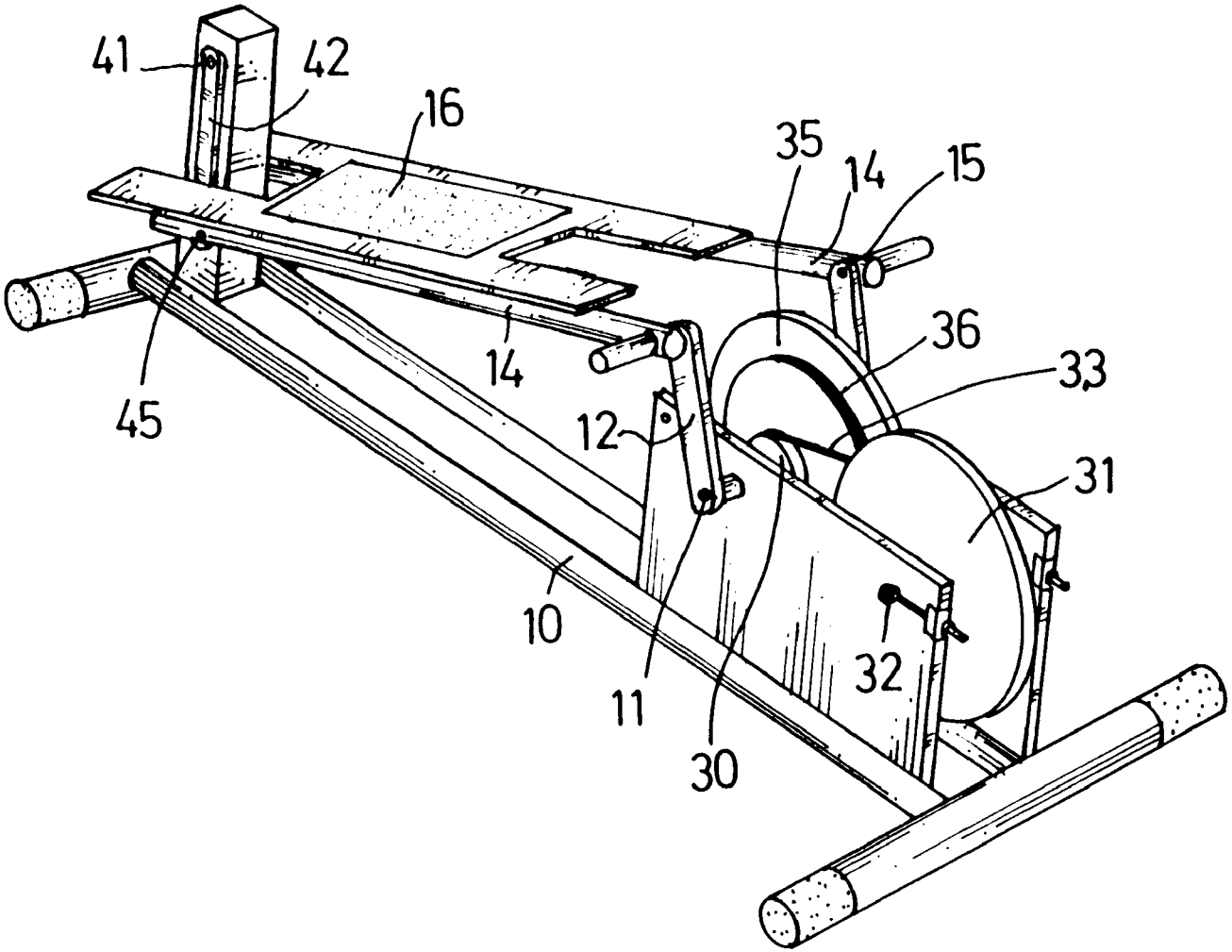
FIG. 1 is a perspective view of a surfing exerciser in accordance with the present invention.
Figure 2:
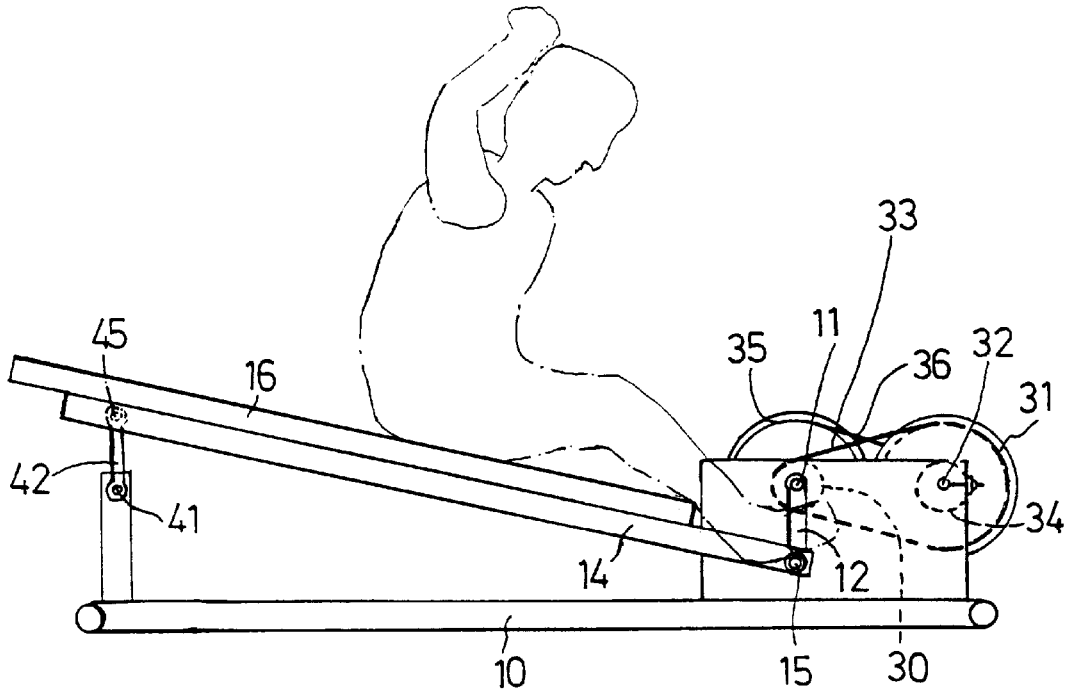
FIGS. 2, 3, 4, 5 are side views illustrating the operation of the surfing exerciser.
Figure 3:
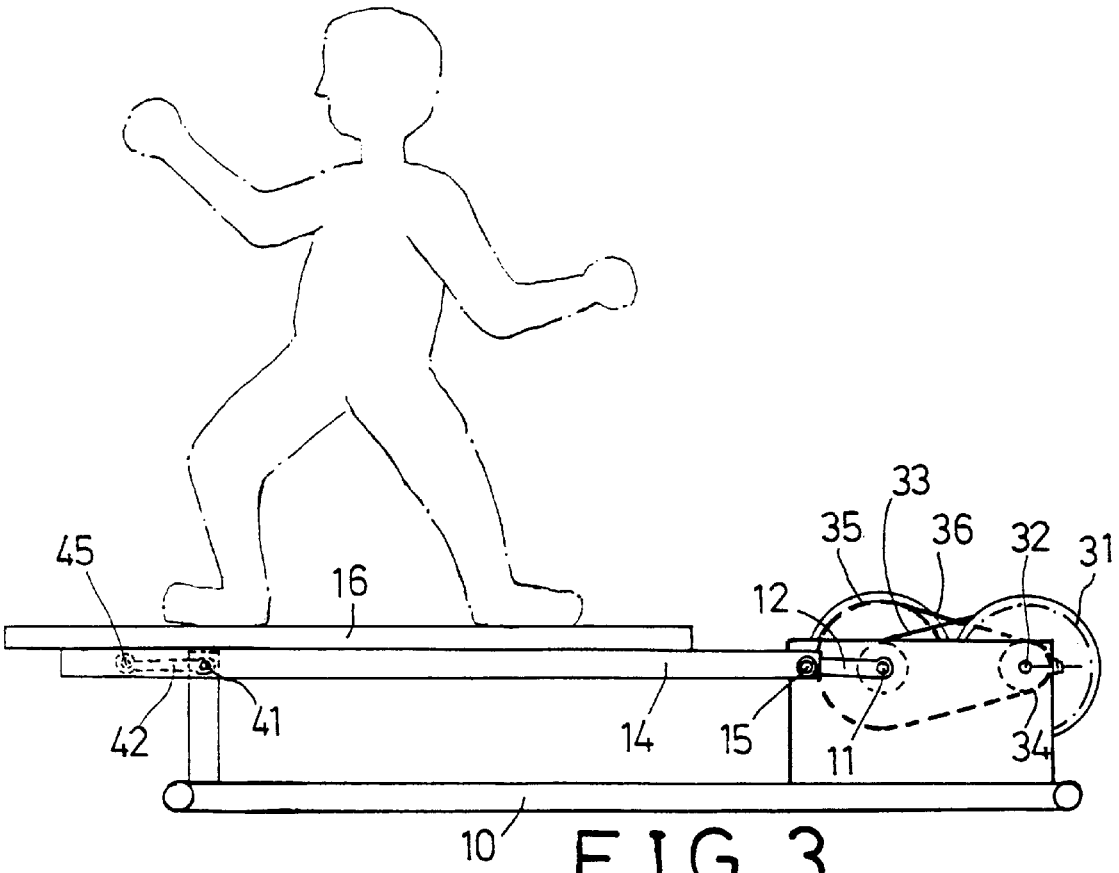
Figure 4:
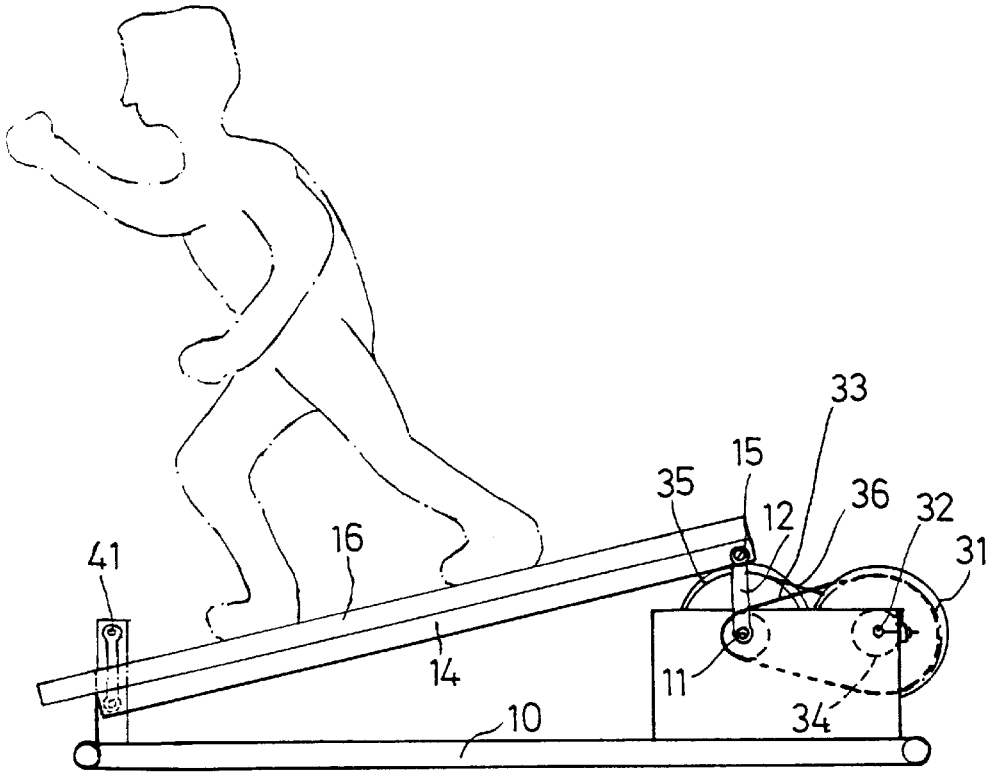
Figure 5:
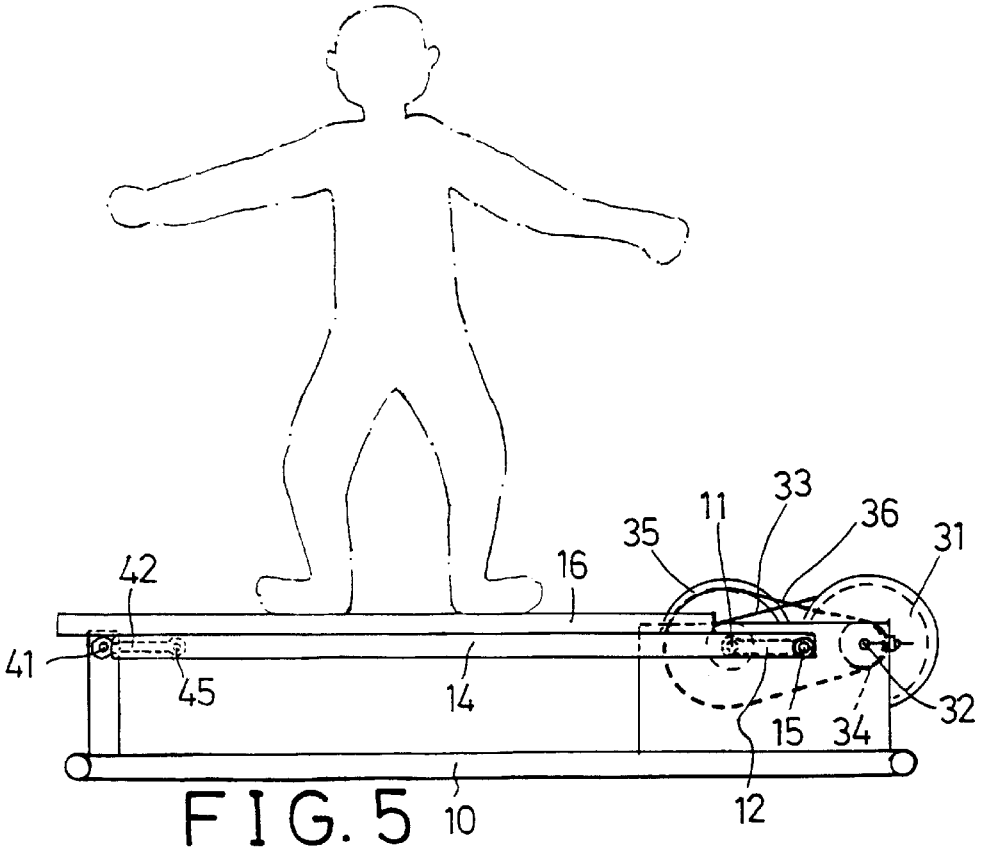

Referring to the drawings, and initially to FIGS. 1 and 2, a surfing exerciser in accordance with the present invention comprises a base 10 including a front shaft 11 and a rear axle

41. A pair of levers 12 have one end secured to the shaft 11 and rotated in concert with the shaft 11. A pair of rods 14 have a front end pivotally secured to the shaft 11 at a pin 15 for allowing the front end of the rods 14 to be rotated about the shaft 11 in a circular and reciprocating action (FIGS. 2–5). A pair of bars 42 have one end rotatably engaged on the axle 41 and have the other pivotally coupled to the rear end of the rods 14 at a pole 45 for allowing the rear end of the rods 14 to be rotated about the axle 41 in a circular and reciprocating action. A board 16 is secured on the rods 14 for supporting one or more users.

In operation, as shown in FIGS. 2–5, the front ends of the rods 14 and of the board 16 may be rotated about the shaft 11 in a circular and reciprocating action, and the rear end of the rods 14 and the board 16 may be rotated about the axle 41 in a circular and reciprocating action which is substantially anti-symmetric relative to that of the front end of the rods 14 and of the board 16, such that the board 16 may be moved in a lateral 8-shaped moving path (i.e.—shaped) for allowing the user to conduct surfing exercises. For example, when the front end of the board 16 moves rearward and upward from that shown in FIG. 2 to FIG. 3, the rear end of the board 16 will move rearward and downward (also) from that shown in FIG. 2 to FIG. 3. When the front end of the board 16 moves forward and upward from that shown in FIG. 3 to FIG. 4, the rear end of the board 16 will move forward and downward. When the front end of the board 16 moves forward and downward from that shown in FIG. 4 to FIG. 5, the rear end of the board 16 will move forward and upward. When the front end of the board 16 moves rearward and downward from that shown in FIG. 5 to FIG. 2, the rear end of the board 16 will move rearward and upward.

The lengths of the levers 12 and of the bars 42 are equal to each other.

Referring again to FIGS. 1 and 2, a small wheel 30 may be secured to the shaft 11 and rotated in concert with the shaft 11. A large wheel 31 and a small wheel 34 may be rotatably secured on the base 10 at a spindle 32. The large wheel 31 may be coupled to the small wheel 30 by a belt 33 or a chain for allowing the wheels 31, 34, 30 to apply a momentum or a resistive force against the rotational movement of the shaft 11. Another large wheel 35 may further be rotatably secured on the shaft 11 and coupled to the small wheel 34 by a chain or a belt 36 for further applying a resistive force against the rotational movement of the shaft 11.

As shown in FIGS. 1 and 2, the pins 15 may each extend laterally outward of the rods 14 for a suitable length and for forming a foot support device and for engaging with the feet of the user.

Accordingly, the surfing exerciser in accordance with the present invention may be provided for allowing people to conduct surfing exercises at home.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base, a board disposed on said base for supporting a user, said board including a front end and a rear end, means for moving said front end of said board in a circular and reciprocating action, and means for moving said rear end of said board in a circular and reciprocating action, said circular and reciprocating action of said rear end of said board being arranged anti-symmetric relative to said circular and reciprocating action of said front end of said board for allowing said board to move along a lateral 8-shaped moving path, said board being provided for allowing the user to conduct surfing exercise when said board is moved along said lateral 8-shaped moving path.

2. The exerciser according to claim 1, wherein said base includes a front portion having a shaft and includes a rear portion having an axle, said front end of said board is pivotally coupled to said shaft for allowing said front end of said board to move in said circular and reciprocating action relative to said shaft, and said rear end of said board is pivotally coupled to said axle for allowing said rear end of said board to move in said circular and reciprocating action relative to said axle.

3. The exerciser according to claim 1 further comprising means for applying a resistive force against said circular and reciprocating actions of said front end and said rear end of said board.

4. The exerciser according to claim 2, wherein said exerciser includes a first wheel secured on said shaft and rotated in concert with said shaft, a second wheel rotatably supported on said base, and means for coupling said second wheel to said first wheel and for allowing said second wheel and said first wheel to apply the resistive force against said circular and reciprocating actions of said front end and said rear end of said board.

* * * * *